US010271579B2

(12) United States Patent
Garay et al.

(10) Patent No.: US 10,271,579 B2
(45) Date of Patent: Apr. 30, 2019

(54) REMOVABLE CUP ATOMIZER

(71) Applicants: Carlos Gomez Garay, Las Vegas, NV (US); Robert Kayvon, Las Vegas, NV (US)

(72) Inventors: Carlos Gomez Garay, Las Vegas, NV (US); Robert Kayvon, Las Vegas, NV (US)

(73) Assignee: DC8 DISTRIBUTION INC., Las Vegas, NV (US)

( * ) Notice: Subject to any disclaimer, the term of this patent is extended or adjusted under 35 U.S.C. 154(b) by 0 days.

(21) Appl. No.: 15/629,566

(22) Filed: Jun. 21, 2017

(65) Prior Publication Data

US 2017/0360101 A1 Dec. 21, 2017

Related U.S. Application Data

(60) Provisional application No. 62/352,829, filed on Jun. 21, 2016.

(51) Int. Cl.

| | |
|---|---|
| ***A24F 13/00*** | (2006.01) |
| ***A24F 47/00*** | (2006.01) |
| ***H05B 3/14*** | (2006.01) |
| ***H05B 3/42*** | (2006.01) |

(52) U.S. Cl.
CPC ..... *A24F 47/008* (2013.01); *H05B 3/141* (2013.01); *H05B 3/42* (2013.01); *H05B 2203/021* (2013.01)

(58) Field of Classification Search
CPC ..... A24F 47/008
USPC ..... 131/328–329
See application file for complete search history.

(56) References Cited

U.S. PATENT DOCUMENTS

| | | | | |
|---|---|---|---|---|
| 5,947,671 | A * | 9/1999 | Kanaan | G05G 1/10 411/408 |
| 9,603,389 | B2 * | 3/2017 | Chen | A61M 15/06 |
| 2015/0272218 | A1 * | 10/2015 | Chen | H05B 3/44 131/329 |
| 2015/0272219 | A1 * | 10/2015 | Hatrick | A24F 47/004 131/328 |
| 2017/0295845 | A1 * | 10/2017 | Bajpai | A24F 47/008 |

* cited by examiner

*Primary Examiner* — Phuong K Dinh

(57) ABSTRACT

A removable cup atomizer comprising a cylindrical body having a hollow interior, a heating element positioned in the hollow interior, a connection means connected to a bottom portion of the cylindrical body. The connection means is configured to provide electrical power. The electrical power heats the heating element. A removable cylindrical cup is positioned on the heating element. The cylindrical cup is configured to accept an amount of matter which is heated by the heating element such that the amount of matter is vaporized and may be inhaled by a user.

20 Claims, 5 Drawing Sheets

REMOVABLE CUP ATOMIZER

CROSS-REFERENCE TO RELATED APPLICATIONS

The present application claims priority to U.S. Provisional application No. 62/352,829, filed on Jun. 21, 2016 entitled "Atomizer", the disclosure of which is hereby incorporated in its entirety at least by reference.

BACKGROUND OF THE INVENTION

1. Field of the Invention

The present invention generally relates to heating elements, but more particularly to a coil-less atomizer.

2. Description of Related Art

An atomizer is used to heat an amount of matter to the point of vaporization when used in a vaporizer or electronic cigarette. When the matter is vaporized, vapor is created which may be inhaled by a user. Atomizers traditional have heating coils that are exposed creating a variety of potential problems during operation, including matter, such as oil leaking from the heating compartment into the battery compartment requiring increased maintenance costs and loss of matter. Further, matter can be lost under the heating coils due to the inefficient design. Consequently, there is a need for a coil-less atomizer to alleviate some of the problems previously mentioned.

In one embodiment of the present invention a coil-less atomizer is provided, comprising a cylindrical body having a hollow interior; a ceramic donut shaped heating element positioned in the hollow interior; a connection means connected to a bottom portion of the cylindrical body, wherein the connection means is configured to connect with a vaporizer and a battery to heat the ceramic donut shaped heating element to a predetermined temperature; and a removable cylindrical cup positioned on the ceramic donut shaped heating element, wherein the cylindrical cup is configured to accept an amount of matter which is heating during operation via thermal conduction from the ceramic donut shaped heating element such that the amount of matter is vaporized and may be inhaled by a user via the vaporizer.

In one embodiment, a threaded cap is provided, wherein the threaded cap is configured to be threaded on the cylindrical body, wherein the threaded cap holds the removable cylindrical cup in position during operation. In one embodiment, the threaded cap is an external cap and the cylindrical body includes external threads configured to receive the threaded cap. In an alternative embodiment, the threaded cap is an internal cap and the cylindrical body including internal threads configured to receive the threaded cap. In one embodiment, the threaded cap includes a pair of grooves configured to allow the use of a lever to rotate the threaded cap. In one embodiment, the cylindrical body is constructed from stainless steel.

In one embodiment, the removable cylindrical cup is titanium. In an alternative embodiment, the removable cylindrical cup is ceramic. In yet another embodiment, the removable cylindrical cup is quartz. In one embodiment, the removable cup has no exposed coils.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best odes contemplated by the inventor of carrying out their invention. Various modifications, however, will remain readily apparent to those skilled in the art, since the general principles of the present invention have been defined herein to specifically provide a coil-less atomizer.

Figure 1:
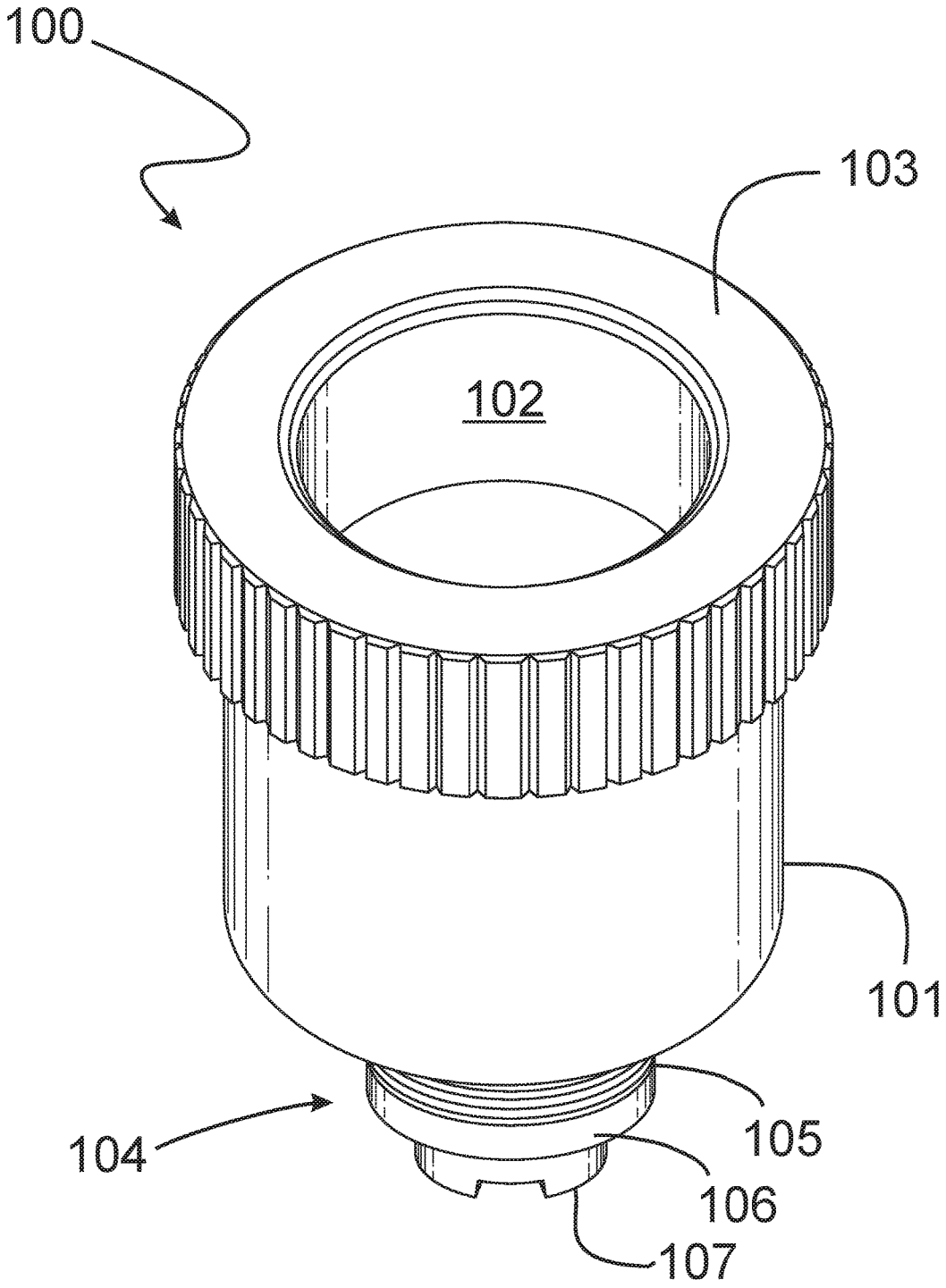
FIG. 1 is a perspective view of a coil-less atomizer according to an embodiment of the present invention.
Figure 2:
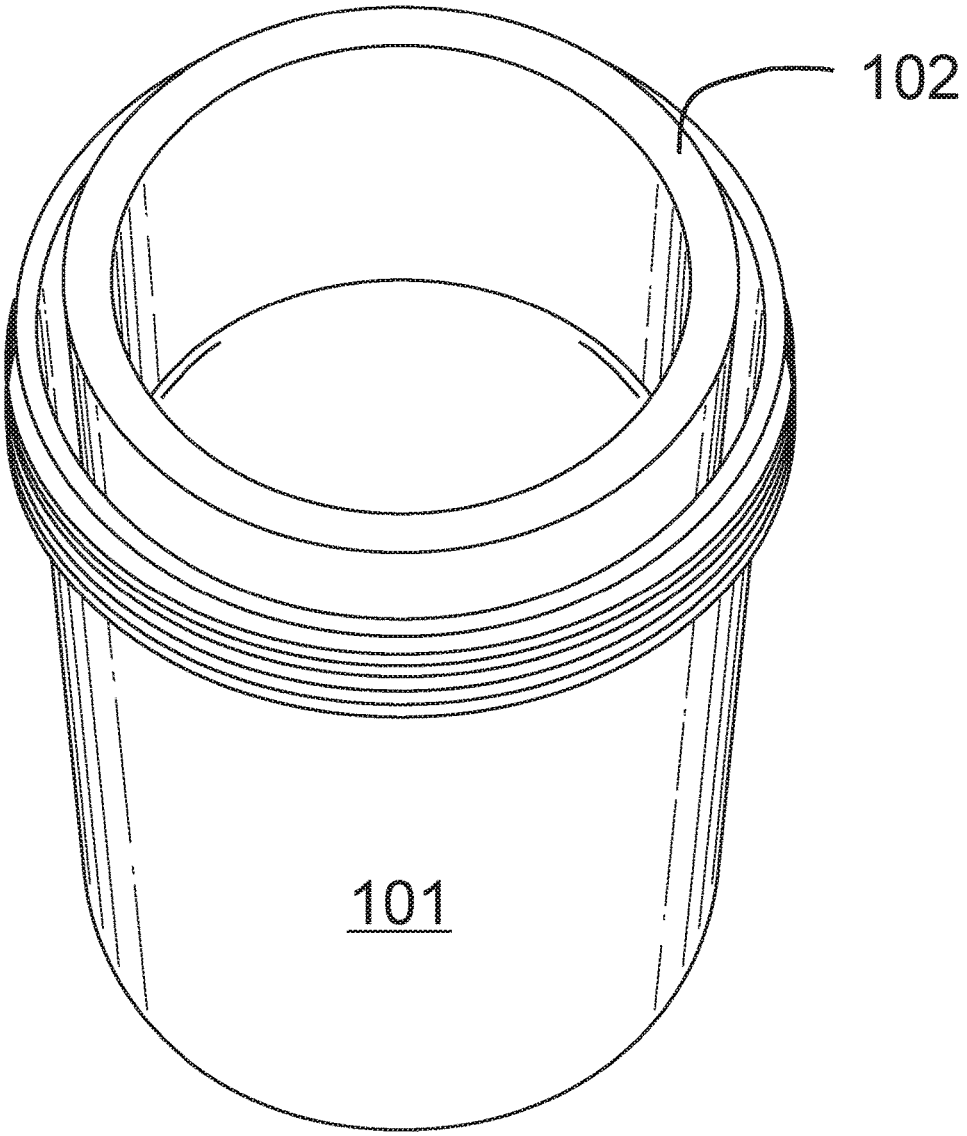
FIG. 2 is a perspective view of the coil-less atomizer with the external cap removed according to an embodiment of the present invention.
Figure 3:
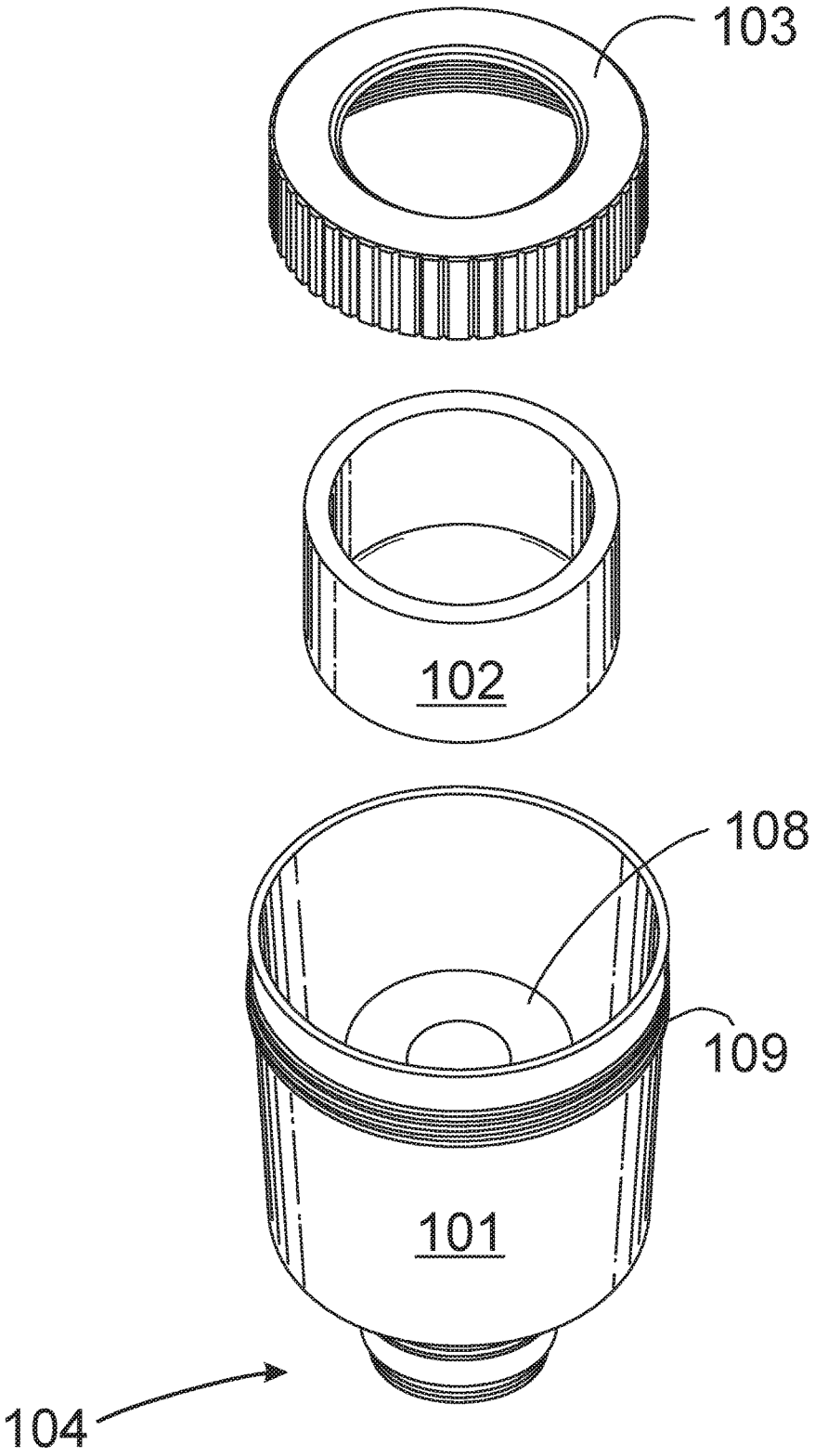
FIG. 3 is an exploded view of the coil-less atomizer according to an embodiment of the present invention.

FIGS. 1-3 are various views of a coil-less atomizer 100 according to an embodiment of the present invention. Referring now to FIGS. 1-3, the coil-less atomizer comprises a cylindrical body 101 having a hollow interior, wherein the cylindrical body is constructed from stainless steel, and preferably grade 303 stainless steel. The coil-less atomizer further comprises a removable cup 102 positioned in the hollow interior and a threaded cap 103 configured to be threaded on the cylindrical body, wherein the threaded cap holds the removable cup in position during operation. In one embodiment, the removable cup has a cylindrical shape sized to fit in the hollow interior. In one embodiment, the threaded cap is constructed from stainless steel, and preferably grade 303 stainless steel. In one embodiment, the threaded cap is an external cap and the cylindrical body includes external threads 109 configured to receive the threaded cap.

In one embodiment, a connection means 104 is connected to a bottom portion of the cylindrical body. The connection means having a thread connection 105, a Teflon gasket 106, and an outlet 107. The connection means is configured to connect with a vaporizer, which will be disused in further details below.

In one embodiment, the hollow interior of the cylindrical body holds a ceramic donut shaped heating element 108. In one embodiment, the heating element is attached to two electrical wires or leads, each wire positioned the length of the coil-less atomizer towards the outlet. In one embodiment, the electrical wires are supported, and separated via the Teflon gasket. During operation, the heating element is heated up to a desired temperature by providing power to the electrical wires. As the heating element is heated to temperature, the removable cup which is seated on the heating element is also being heated via thermal conduction. An amount of matter desired to be vaporized is positioned in the removable cup during operation. In one embodiment, the removable cup is constructed from a ceramic material. In another embodiment, the removable cup is constructed from a titanium material, wherein the titanium material is preferably grade 2 titanium. In yet another embodiment, the removable cup is constructed from a quartz material.

It is a particular advantage that the user may switch out different removable cups between uses, depending on which material is desired, as each material provides a different vaping experience. Unlike traditional fixed cups in atomizers found in the prior art, the removable cup has no exposed heating coils and is removable. The removability allows for easy cleaning and maintenance. Further since there are no exposed heating coils, there is a larger capacity for matter, and the matter doesn't get caught under the exposed coils and/or heating elements as with traditional fixed cups having exposed heating coils of the prior art. Also, since exposed heating coils require openings to be provided in the fixed cup for electrical wires, matter can often leak through the openings potentially damaging the atomizer and/or battery. It is a particular object of the present invention to provide an atomizer specifically designed for concentrates. However, it is understood that other forms of matter may be used, including but not limited to oil, liquid, or wax.

Figure 4:
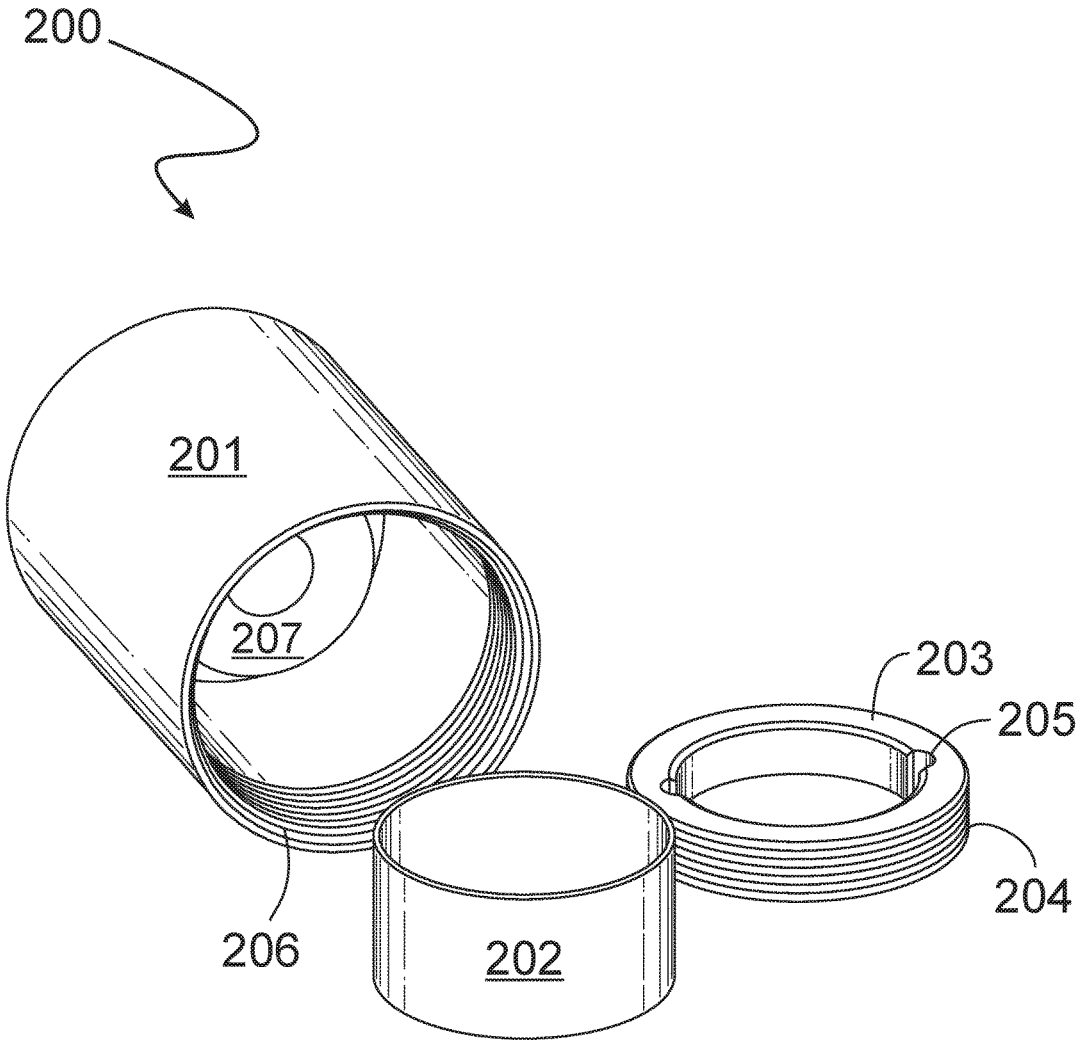
FIG. 4 is a perspective view of a coil-less atomizer having an internal threaded cap according to an embodiment of the present invention.

FIG. 4 is a perspective view of a coil-less atomizer 200 having an internal threaded cap 203 according to an embodiment of the present invention. Referring now to FIG. 4, the alternative coil-less atomizer is illustrated. This atomizer functions the same as previously discussed and has the same components including but not limited to a cylindrical body 201, a removable cup 202 and ceramic donut shaped heating element 207, however it has an internal threaded cap 203 rather than an external cap as previously described. The internal threaded cap includes external threads 204 configured to engage internal threads 206 positioned in a hollow interior of the cylindrical body. In one embodiment, the internal threaded cap includes a pair of grooves 205 configured to allow the use of a lever to rotate the internal threaded cap facilitating the removable of the cap, such that the removable cup can he removed to provide all the advantages previously discussed.

Figure 5:
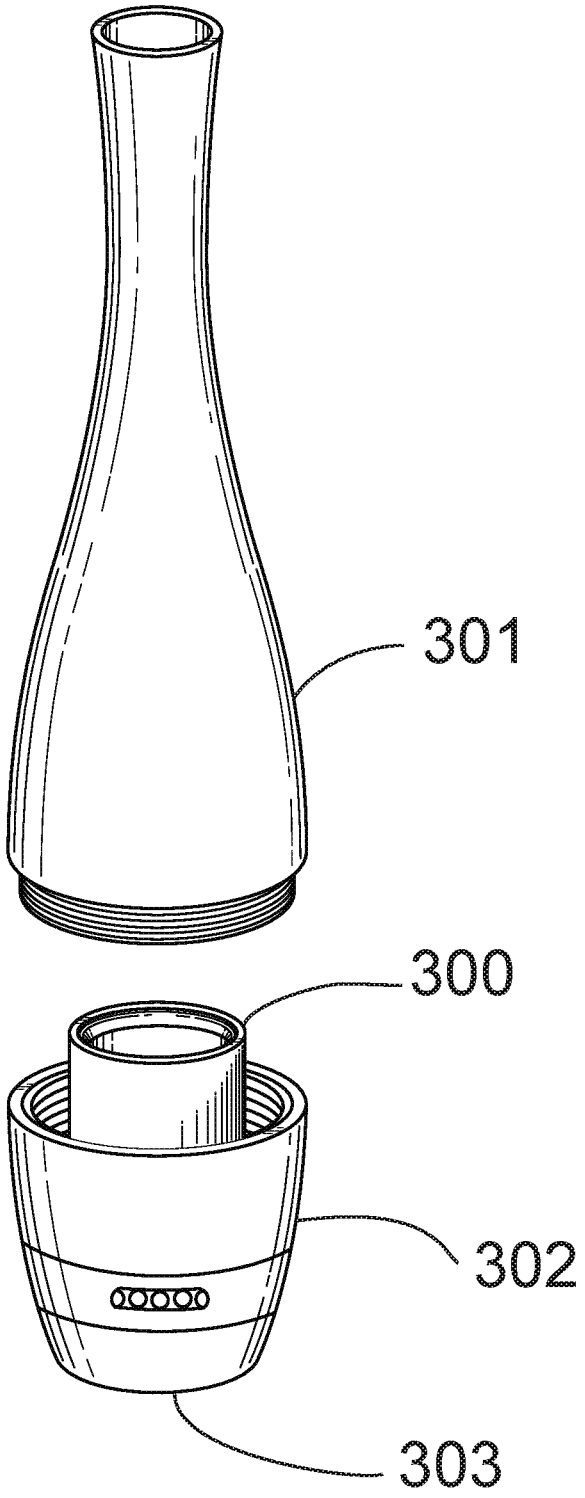
FIG. 5 is a perspective view of a coil-less atomizer in use according to an embodiment of the present invention.

FIG. 5 is a perspective view of a coil-less atomizer 300 in use according to an embodiment of the present invention. Referring now to FIG. 5, the connection means is configured to connect with a vaporizer 302, such that the thread connection of the connection means is in threaded engagement with the vaporizer allowing the outlet to be positioned to accept a battery (not illustrated) in a bottom portion 303 of the vaporizer. The vaporizer is powered via the battery or multiple batteries as well known in the art. As well known in the art, electrical power is transferred via the electrical wires to heat up the heating element. Through the thermal conduction the removable cup is heated and the corresponding matter. Once the matter reaches its predetermined vaporizing temperature, the vapor is released and may be inhaled by the user via the mouth piece 301.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A removable cup atomizer comprising:

a cylindrical body having a hollow interior;

a ceramic donut shaped heating element positioned in the hollow interior;

a connection means connected to a bottom portion of the cylindrical body, wherein the connection means is configured to electrically connect with electrical power to heat the ceramic donut shaped heating element to a predetermined temperature; and a removable cylindrical cup is separate and independent from the donut shaped heating element positioned on the ceramic donut shaped heating element, wherein the removable cup is one-piece with side walls and a bottom wherein the cylindrical cup is configured to accept an amount of matter which is heating during operation via thermal conduction from the ceramic donut shaped heating element such that the amount of matter is vaporized and may be inhaled by a user via a vaporizer.

2. The removable cup atomizer of claim 1, further comprising a threaded cap configured to be threaded on the cylindrical body, wherein the threaded cap holds the removable cylindrical cup in position during operation.

3. The removable cup atomizer of claim 2, wherein the threaded cap is an external cap and the cylindrical body includes external threads configured to receive the threaded cap.

4. The removable cup atomizer of claim 2, wherein the threaded cap is an internal cap and the cylindrical body including internal threads configured to receive the threaded cap.

5. The removable cup atomizer of claim 4, wherein the threaded cap includes a pair of grooves.

6. The removable cup atomizer of claim 1, wherein the cylindrical body is constructed from stainless steel.

7. The removable cup atomizer of claim 1, wherein the removable cylindrical cup is titanium.

8. The removable cup atomizer of claim 1, wherein the removable cylindrical cup is ceramic.

9. The removable cup atomizer of claim 1, wherein the removable cylindrical cup is quartz.

10. A removable cup atomizer comprising:

a cylindrical body having a hollow interior;

a heating element positioned in the hollow interior;

a connection means connected to a bottom portion of the cylindrical body, wherein the connection means is configured to electrically connect to electrical power to heat the heating element; and a removable cup that is separate and independent from the heating element, where the removable cup is one piece and has side walls and a bottom and the removable cup is touching the heating element, wherein the removable cup is configured to accept an amount of matter which is heated during operation via thermal conduction from the heating element such that the amount of matter is vaporized and may be inhaled by a user.

11. The removable cup atomizer of claim 10, further comprising a cap configured to hold the removable cup in position during operation.

12. The removable cup atomizer of claim 11, wherein the cap is an external cap and the cylindrical body is configured to receive the external cap.

13. The removable cup atomizer of claim 12, wherein the cap is threaded and the cylindrical body includes external threads configured to receive the threads of the external cap.

14. The removable cup atomizer of claim 11, wherein the cap is an internal cap and the cylindrical body is configured to receive the internal cap.

15. The removable cup atomizer of claim 14, wherein the cap is threaded and the cylindrical body includes internal threads configured to receive the threads of the internal cap.

16. The removable cup atomizer of claim 15, wherein the cap includes a pair of grooves.

17. The removable cup atomizer of claim 10, wherein the cylindrical body is constructed from metal.

18. The removable cup atomizer of claim 10, wherein the removable cup is metal.

19. The removable cup atomizer of claim 10, wherein the sidewalls are cylindrical and the bottom is flat.

20. A removable cup atomizer comprising:

a cylindrical body having a hollow interior;

a heating element positioned in the hollow interior;

a connection means connected to a bottom portion of the cylindrical body, wherein the connection means is configured to electrically connect to electrical power to heat the heating element;

a removable cup that is separate and independent from the heating element, where the removable cup has side walls and a bottom, and the sidewalls are cylindrical and the bottom is flat and the removable cup is positioned on the heating element, wherein the cylindrical cup is configured to accept an amount of matter which is heated without the matter coming in contact with the heating element during operation when the amount of matter is vaporized and may be inhaled by a user via a vaporizer; and a threaded cap configured to be threaded on the cylindrical body, wherein the threaded cap holds the removable cup in position during operation, wherein the threaded cap is an external cap and the cylindrical body includes external threads configured to receive the threaded cap.

* * * * *